US010619417B2

(12) United States Patent
Ostrobrod

(10) Patent No.: US 10,619,417 B2
(45) Date of Patent: Apr. 14, 2020

(54) PASS-THROUGH CABLE GRAB SYSTEM

(71) Applicant: Meyer Ostrobrod, Philadelphia, PA (US)

(72) Inventor: Meyer Ostrobrod, Philadelphia, PA (US)

( * ) Notice: Subject to any disclaimer, the term of this patent is extended or adjusted under 35 U.S.C. 154(b) by 0 days.

(21) Appl. No.: 15/915,256

(22) Filed: Mar. 8, 2018

(65) Prior Publication Data

US 2019/0277088 A1 Sep. 12, 2019

(51) Int. Cl.
*A62B 1/14* (2006.01)
*E06C 7/18* (2006.01)

(52) U.S. Cl.
CPC ..... *E06C 7/186* (2013.01); *A62B 1/14* (2013.01)

(58) Field of Classification Search
CPC ..... E06C 7/186; A62B 35/0087; A62B 1/14
USPC ..... 182/36
See application file for complete search history.

(56) References Cited

U.S. PATENT DOCUMENTS 4,560,029 A 12/1985 Dalmaso
4,790,410 A * 12/1988 Sharp ..... A62B 35/0056 182/12
5,156,240 A 10/1992 Ostrobrod
5,924,522 A 7/1999 Ostrobrod
6,056,085 A * 5/2000 Cutter ..... A62B 35/0056 182/36
2002/0050421 A1* 5/2002 Lara ..... A62B 35/0056 182/36
2003/0029673 A1* 2/2003 Puszkiewicz ..... B66F 9/06 182/69.1
2004/0211622 A1* 10/2004 Renton ..... A62B 35/0056 182/3
2007/0119653 A1* 5/2007 Brown ..... A62B 1/14 182/36
2010/0108440 A1* 5/2010 Maes ..... A62B 35/0056 182/3

(Continued)

FOREIGN PATENT DOCUMENTS

CH 708749 B1 * 5/2015 ..... A62B 35/0056
EP 0486411 A1 * 5/1992 ..... A62B 35/0056

(Continued)

*Primary Examiner* — Alvin C Chin-Shue
(74) *Attorney, Agent, or Firm* — Norman E. Lehrer

(57) ABSTRACT

A pass-through cable grab system which allows a workman wearing a harness to move up and down a ladder on a tower or similar structure while being protected from falling by a vertically extending safety cable attached to the tower. The system includes at least one standoff bracket having a rear end secured to the tower and a forward end secured to the cable. A cable grab assembly includes a housing that can move vertically up and down the cable and further includes a brake mechanism. A lever extends from the housing and is connected to the workman through a lanyard. In the event of a fall, the lever moves downwardly activating the brake mechanism. The housing includes a vertically extending slot which allows the cable grab assembly to pass over the forward end of the standoff bracket as the cable grab assembly moves up and down. The standoff bracket also includes cam surfaces adjacent the top and bottom thereof which engage the housing as it moves toward the bracket to properly align the cable grab assembly so that it can pass over the standoff bracket.

4 Claims, 6 Drawing Sheets

(56) References Cited

U.S. PATENT DOCUMENTS

| | | | | |
|---|---|---|---|---|
| 2011/0024230 | A1* | 2/2011 | Mahr | A62B 1/04<br>182/36 |

FOREIGN PATENT DOCUMENTS

| | | | | |
|---|---|---|---|---|
| EP | 1900394 | A1 * | 3/2008 | A62B 35/005 |
| WO | WO-2016093850 | A1 * | 6/2016 | A62B 1/14 |

* cited by examiner

PASS-THROUGH CABLE GRAB SYSTEM

FIELD OF THE INVENTION

The present invention is directed toward a cable grab safety system and, more particularly, toward such a system which is intended to be used by a workman working on a communications or power line tower which allows him to freely move up or down but which will gradually and safely arrest his fall should he slip or otherwise fall from the tower. The invention is an improvement on Applicant's prior U.S. Pat. No. 5,924,522 entitled "Cable Grab" and U.S. Pat. No. 5,156,240 entitled "Rope Grab," the entire contents of which are incorporated herein by reference.

BACKGROUND OF THE INVENTION

As explained in Applicant's above-identified patents, in response to government rules and regulations and a general desire for safety, rope or cable grabs or similar safety devices have become a requirement for workers working in elevated positions such as on scaffolding or on ladders or the like. Such rope or cable grabs are used in conjunction with a vertical cable or rope which is suspended from a position above the worker to substantially the ground level where it is also secured so as to ensure that the rope or cable is maintained in a vertical position.

Typical rope or cable grabs are used in conjunction with a safety belt or harness which is fastened about the worker. A lanyard is secured to the safety belt or harness and the free end thereof is secured to the rope or cable grab. The lanyard is relatively short but is of sufficient length to allow the worker some freedom of movement in horizontal directions. An ideal rope or cable grab should move freely up and down the rope or cable as the worker slowly moves up or down. However, in the event that the worker loses his balance or otherwise is caused to fall, the lanyard causes the rope or cable grab to grip the rope or cable. This breaks the fall by gripping the rope or cable which first slows the worker and eventually stops the fall within several feet.

As is more fully explained in Applicant's prior U.S. Pat. No. 5,156,240 entitled "Rope Grab", prior art rope grab devices have proven less than totally acceptable for several different reasons. Some types of rope grabs cannot be attached to or removed from the rope without the necessity of threading the end of the rope through the connector. This is not practical when the suspended rope is several hundred feet long. Hinging and clamping arrangements have been proposed as a solution to this problem but none of them has been found to be entirely satisfactory. The hinged device shown in prior U.S. Pat. No. 4,560,029, for example, has been known to deform upon stopping the fall of a fallen worker which deformation makes it difficult to operate safely thereafter.

Prior known devices and, particularly those of the hinged type, are also not easy to assemble on the rope or cable. Assembly frequently requires a two-hand operation and, quite frequently, a worker working at an elevated position normally only has one hand free.

Another disadvantage found in many conventional rope or cable grab devices is that they cannot be moved freely up or down the rope or cable when the worker moves about. Many of these devices require that the worker hold the device in an open position with a hand grip in order to move the same. This may be difficult when the worker's hands are otherwise occupied. Furthermore, in the event of a fall, the worker may panic and may not release his grip which would cause the rope or cable grab to malfunction and which would, of course, be disastrous to him.

Another serious problem of prior rope grab devices is the manner in which the rope grab grips the rope. The gripping mechanism of most rope grabs includes a cam-lever arrangement wherein a braking cam having teeth or serrated cam surfaces grips the cable. The force at which the cams grab the rope of these prior art devices is directly related to the weight of the worker and the short distance that he free falls before the rope grab is activated. The result is that the sudden stop can injure the worker.

Furthermore, in safety tests required by law or regulations in many jurisdictions, where a weight simulating a worker was dropped a short distance to simulate a fall, the suspended rope which may be a ⅝ or ¾ inch nylon or manila rope was either broken or substantially weakened by the rope grab because of the sudden shock upon it and the cutting of the rope by the braking cams. The Occupational Safety and Health Administration (OSHA) has established standards which must be met for rope grabs and ropes used therewith. These are published at 29 CFR 1910 Appendix C. Many prior art devices, however, are not capable of meeting these requirements.

The rope grab described in Applicant's prior U.S. Pat. No. 5,156,240 is believed to have solved most of the problems of prior art rope grabs and has been commercially successful in the marketplace. It has been found, however, that Applicant's rope grab cannot be used with steel cable due inter alia to the serrated nature of the gripping teeth. While rope is commonly used in indoor environments and for temporary outdoor use, steel cable is required in most outdoor operations in view of the durability of the same.

The primary purpose of the invention described in Applicant's U.S. Pat. No. 5,924,522 was to provide a safety device that could be used with a steel cable since the rope grab of Applicant's U.S. Pat. No. 5,156,240 was not useful with the same. Applicant's improved cable grab has been very successful. However, an additional requirement has now been introduced which neither Applicant's prior Rope Grab nor Cable Grab is capable of meeting. Similarly, Applicant is not aware of any other prior device that is capable of meeting this new requirement.

When a vertical safety cable or rope is used with a tower such as an antenna or other communications tower or a power line tower, it is secured to the tower adjacent the top thereof and, like most vertical safety cables, is secured at the bottom. In addition, OSHA also requires that the cable be rigidly secured to the tower at a number of intermediate positions. Currently, the cable is required to be secured to the tower every 40 feet. This creates problems for all known cable or rope grabs as they are incapable of passing up or down over the standoff or bracket that secures the cable to the tower at the intermediate positions.

There is, therefore, a need for a cable grab that will safely and automatically prevent a workman from falling from a tower and which is also capable of passing the intermediate standoffs or brackets that secure the cable to the tower.

SUMMARY OF THE INVENTION

The present invention is designed to overcome the problems of the prior art devices described above and provides a pass-through cable grab system which allows a workman wearing a harness to move up and down a ladder on a tower or similar structure while being protected from falling by a vertically extending safety cable attached to the tower. The system includes at least one standoff bracket having a rear end secured to the tower and a forward end secured to the cable. A cable grab assembly includes a housing that can move vertically up and down the cable and further includes a brake mechanism. A lever extends from the housing and is connected to the workman through a lanyard. In the event of a fall, the lever moves downwardly activating the brake mechanism to prevent the workman from falling. The housing includes a vertically extending slot which allows the cable grab assembly to pass over the forward end of the standoff bracket as the cable grab assembly moves up and down. The standoff bracket also includes cam surfaces adjacent the top and bottom thereof which engage the housing as it moves toward the bracket to properly align the cable grab assembly so that it can pass over the standoff bracket.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 1:
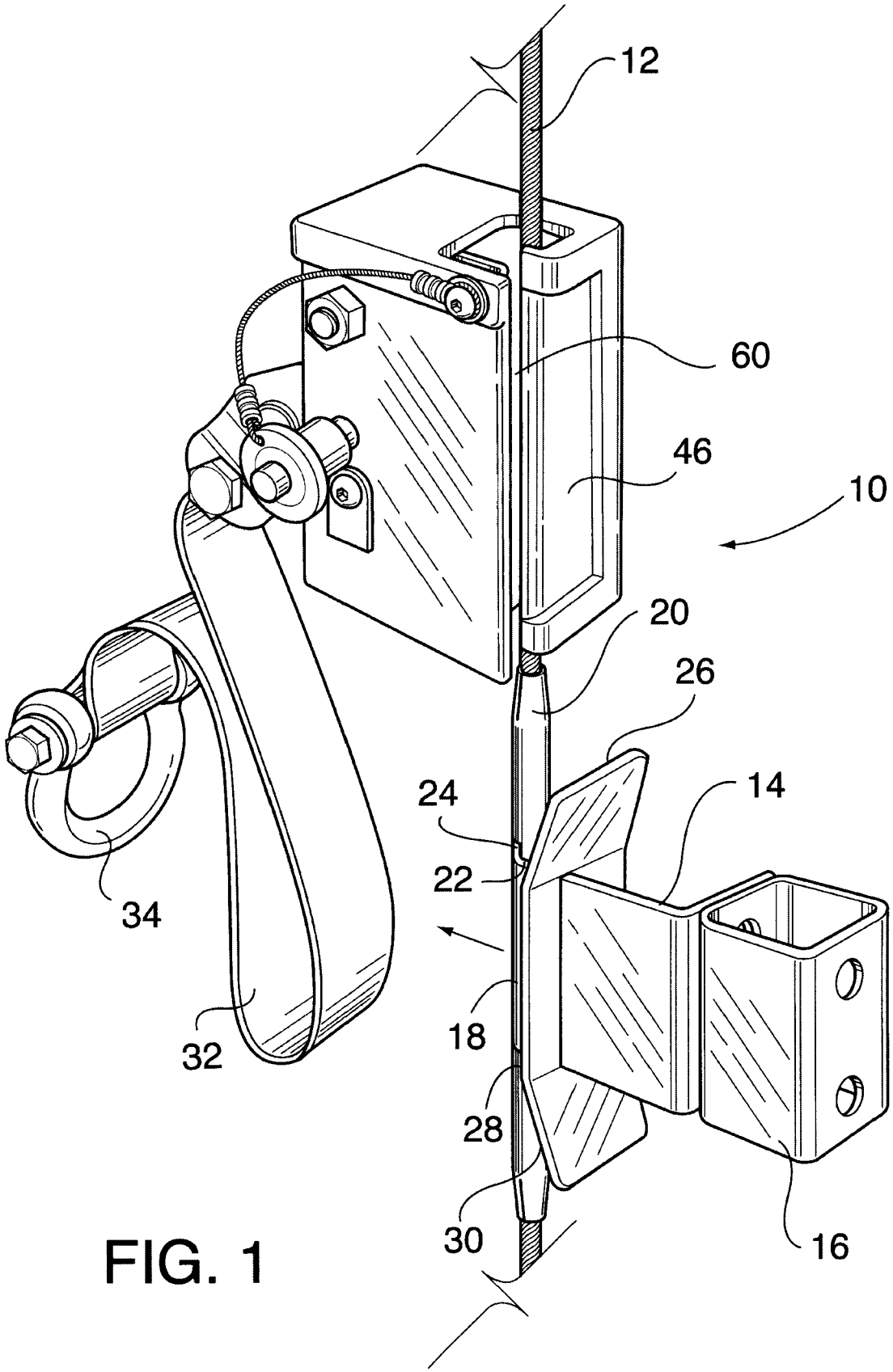
FIG. 1 is a rear right side perspective view of a pass-through cable grab constructed in accordance with the prior invention as the same is used on a vertically suspended steel safety cable.
Figure 2:
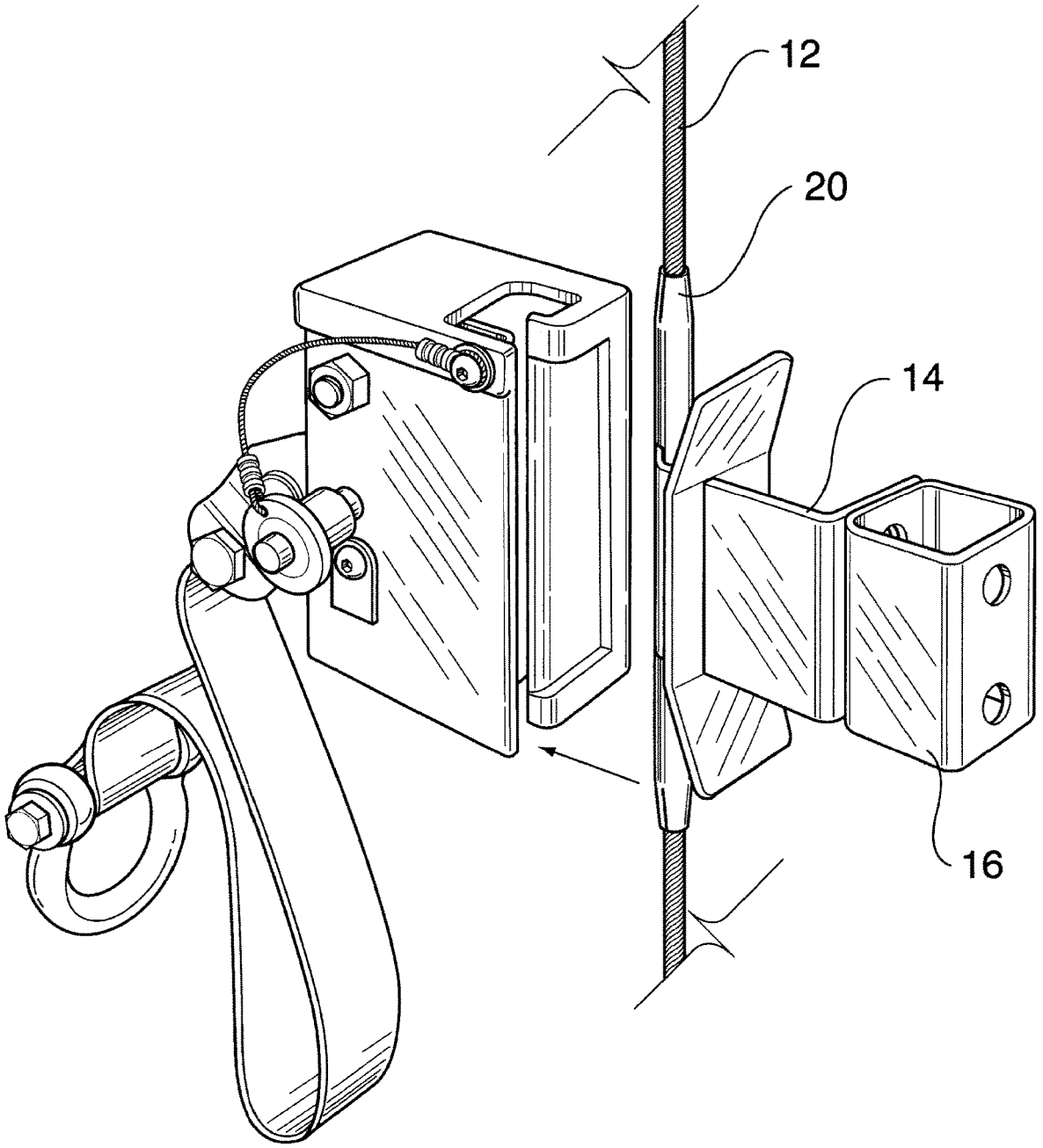
FIG. 2 is a perspective view similar to FIG. 1 with the cable grab detached from the cable.

Referring to the drawings in detail wherein like reference numerals have been used throughout the various figures to designate like elements, there is shown in each of the figures a pass-through cable grab system constructed in accordance with the principles of the prior invention and designated generally as 10. In FIG. 1 pass-through cable grab 10 is shown in place on a vertically extending steel safety cable 12. Cable 12 may be only feet long or may be hundreds of feet long. While steel is the material from which most safety cables are made, it is also possible to produce them from other metals and alloys. The cables normally have a diameter of 5/16 to 3/8 inch, although the thickness of the cable 12 and other specifications concerning the same are regulated by federal regulations and the regulations in several states. Furthermore, the pass-through cable grab 10 is preferably designed to be used with a particular size cable. That is, various different sizes of cable grabs may be made available for different size cables.

In the environment of the present invention, the cable 12 is secured to a vertical tower (not shown) which may be an antenna or other communications tower or a power line tower or the like. It is not beyond the scope of the present invention, however, to utilize the pass-through cable grab 10 with a cable 12 that is attached to a building or other structure. In any event, the cable 12 is attached to the tower adjacent the top thereof and near the bottom. In addition, a plurality of standoff brackets, such as shown at 14, secure the cable 12 to the tower at intermediate vertical positions along the height thereof. Under current OSHA regulations, the cable 12 must be attached to the tower at least every 40 feet.

Each bracket 14 includes a rear section 16 that is adapted to be connected to the tower and a forward section 18 that is connected to the cable 12. The connection to the cable is by way of a metal sleeve 20 that is securely crimped about the cable. The forward section 18 of the bracket 14 includes a first portion 22 that extends directly away from the tower (i.e. in the direction of the arrow in the figures) and a second portion 24 connected thereto that extends in an angular direction therefrom. It is the distal end of the second portion 24 that connects to the cable 12 through the sleeve 20.

Each bracket 14 also includes a plurality of cam surfaces that, as described in more detail below, help guide the pass-through cable grab 10 passed the bracket. These cam surfaces include an upper cam surface 26, an intermediate cam surface 28 and a lower cam surface 30. As can be seen in the figures, the intermediate cam surface 28 is essentially a substantially vertically extending flat surface having a height and a width. The upper cam surface 26 extends upwardly from the intermediate cam surface 28 but is bent backwardly somewhat toward the tower. In a similar manner, the lower cam surface 30 extends downwardly from the intermediate cam surface 28 and is bent backwardly toward the tower.

As with other known cable grabs, the pass-through cable grab 10 is connected to a worker through the use of a lanyard 32 which may be relatively short or up to 42 inches long in accordance with OSHA requirements. The free end 34 of the lanyard 32 is connected to the worker through a safety belt or harness worn by the worker. The near end 36 of the lanyard is connected to the pass-through cable grab 10 by attaching the same to the first end 38 of the brake lever 40, the details of which will be explained more fully hereinafter.

The manner in which the pass-through cable grab 10 of the present invention operates to prevent a fall is essentially the same as the cable grab described in prior U.S. Pat. No. 5,924,522, the entire contents of which are hereby incorporated by reference. Accordingly, only a brief description thereof is believed to be necessary.

The pass-through cable grab 10 is comprised essentially of two parts: a housing 42 and a brake mechanism 44 located within the housing. The cable 12 passes through the housing 42 as shown in FIG. 1. Or, said another way, the housing 42 surrounds the cable 12. In either case, the cable 12 lies between the inside 45 of the rear wall 46 of the housing and the pulley wheel 48. The pulley wheel 48 is mounted on an axle 50 which can ride up and down an elongated slot 52. A forked opening 54 in the second end of the brake lever 40 moves the pulley wheel 48 upwardly toward the inside surface 45 of the wall 46 or downwardly away from the wall 46. A spring 56 biases the pulley wheel 48 upwardly and toward the wall 46 to move the cable 12 toward the inside surface 45 of the wall, i.e. into the braking position.

Figure 3:
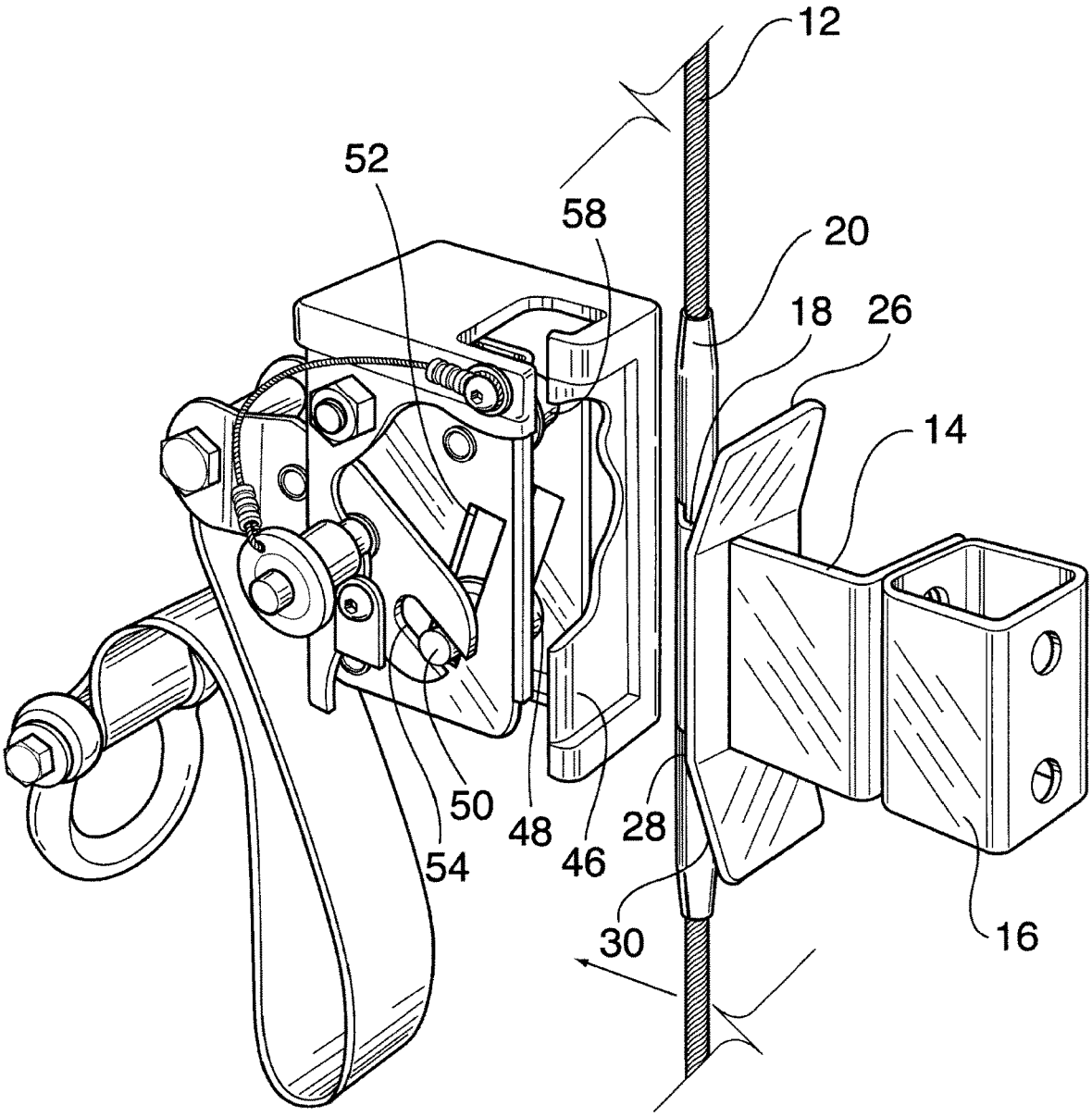
FIG. 3 is a perspective view similar to FIG. 2 but with parts broken away to show the inside of the cable grab in its nonbraking condition.
Figure 4:
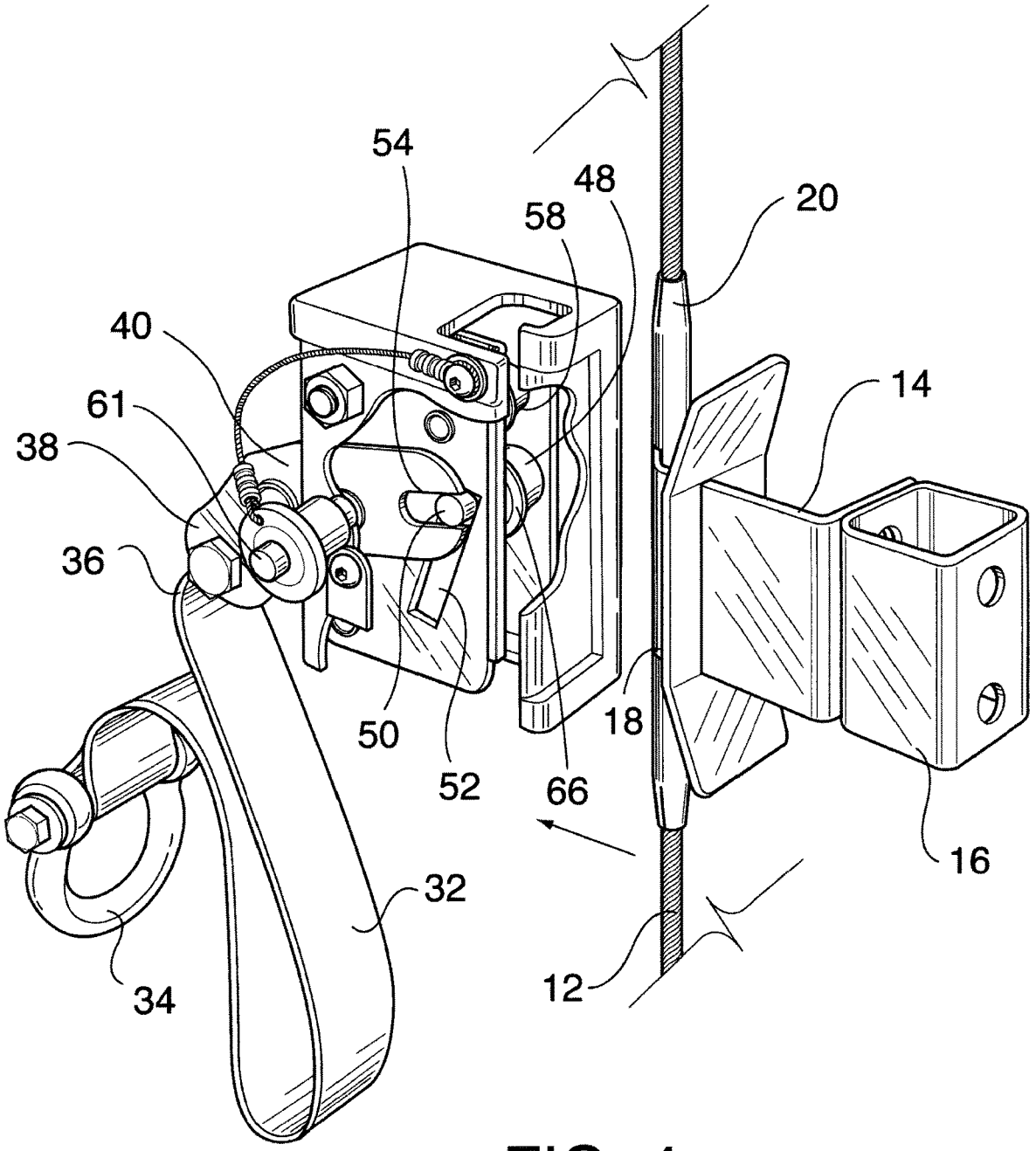
FIG. 4 is a perspective view similar to FIG. 3 showing the cable grab in its braking condition.

As with the cable grab described in Applicant's prior patent, the pass-through cable grab 10 functions as a brake when a workman falls by having the lever 40 move the pulley wheel 48 against the cable 12. This forces the cable against the inside surface 45 of the wall 46. There will, of course, be some slippage which is desirable so as to avoid a sudden shock but after the cable grab 10 moves for several feet along the length of the cable 12, eventually it will function to brake the worker's fall. As is also clear from FIGS. 3 and 4, the cable 12 is guided through the cable grab 10 through the use of the upper roller 58. This helps to maintain the cable grab 10 properly oriented in a vertical position.

The length of the lanyard 32 allows the worker to move in a horizontal direction to either side of the safety cable 12. As the worker moves higher, the lanyard pulls up on the end 38 of brake lever 40 which, in turn, pulls the entire cable grab 10 upwardly with the worker. As long as the lanyard is above the height of the cable grab 10 and there is some upward force on the lanyard, the weight of the main portion of the cable grab maintains the end 38 of the lever 40 in its upward position so that the entire cable grab can freely move downwardly along the safety cable 12 as the worker descends slowly. Of course, should the worker fall, the end 38 of the lever 16 will move downwardly into its braking position and the cable grab 10 will arrest the fall of the worker.

Figure 5:
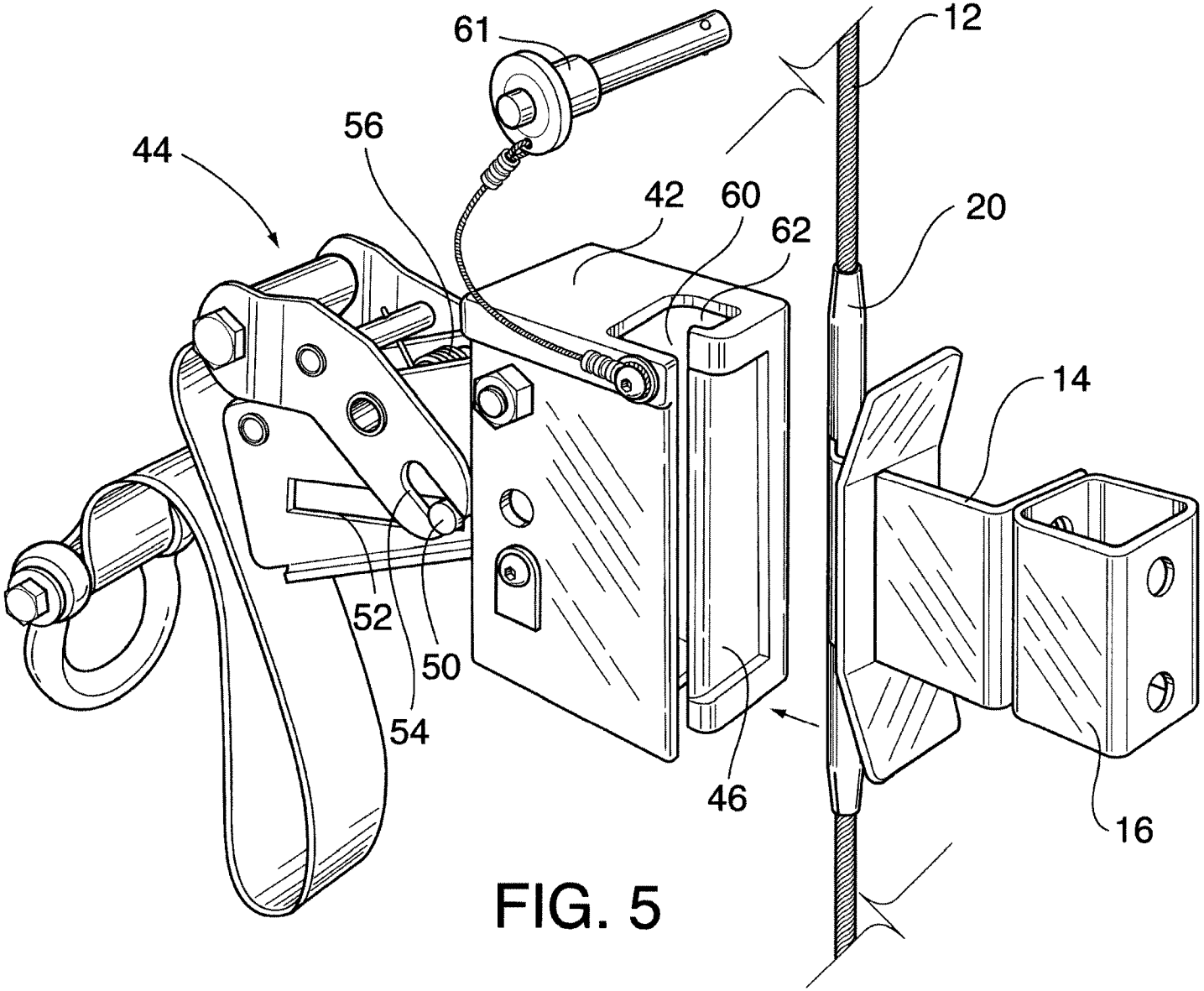
FIG. 5 is a perspective view similar to the other figures but showing the braking mechanism removed from the housing.

The rear wall 46 of the housing 42 includes a vertically extending slot or opening 60. This slot has two primary functions. First, it allows the pass-through cable grab 10 to be attached to the cable 12 at any location along the length of the cable. This is accomplished by removing the pin 61 that secures the brake mechanism 44 to the housing 42 and then removing the brake mechanism from the housing as shown in FIG. 5. The housing 42 is then moved toward the cable 12 allowing the cable to pass-through the slot 60. The cable 12 is then positioned in the larger vertical opening or passageway 62 where it lies in front of the inner surface 45 of the wall 46. Once the cable is in place, the break mechanism 44 is reinserted and the cable now lies between the pulley wheel 48 and the inner surface 45 allowing the cable grab 10 to function as described above. The cable grab 10 cannot be removed from the cable 12 as the cable is held in place and cannot pass-through the space between the projection 64 on the wall 46 and the flange 66 on the wheel 48.

Figure 6:
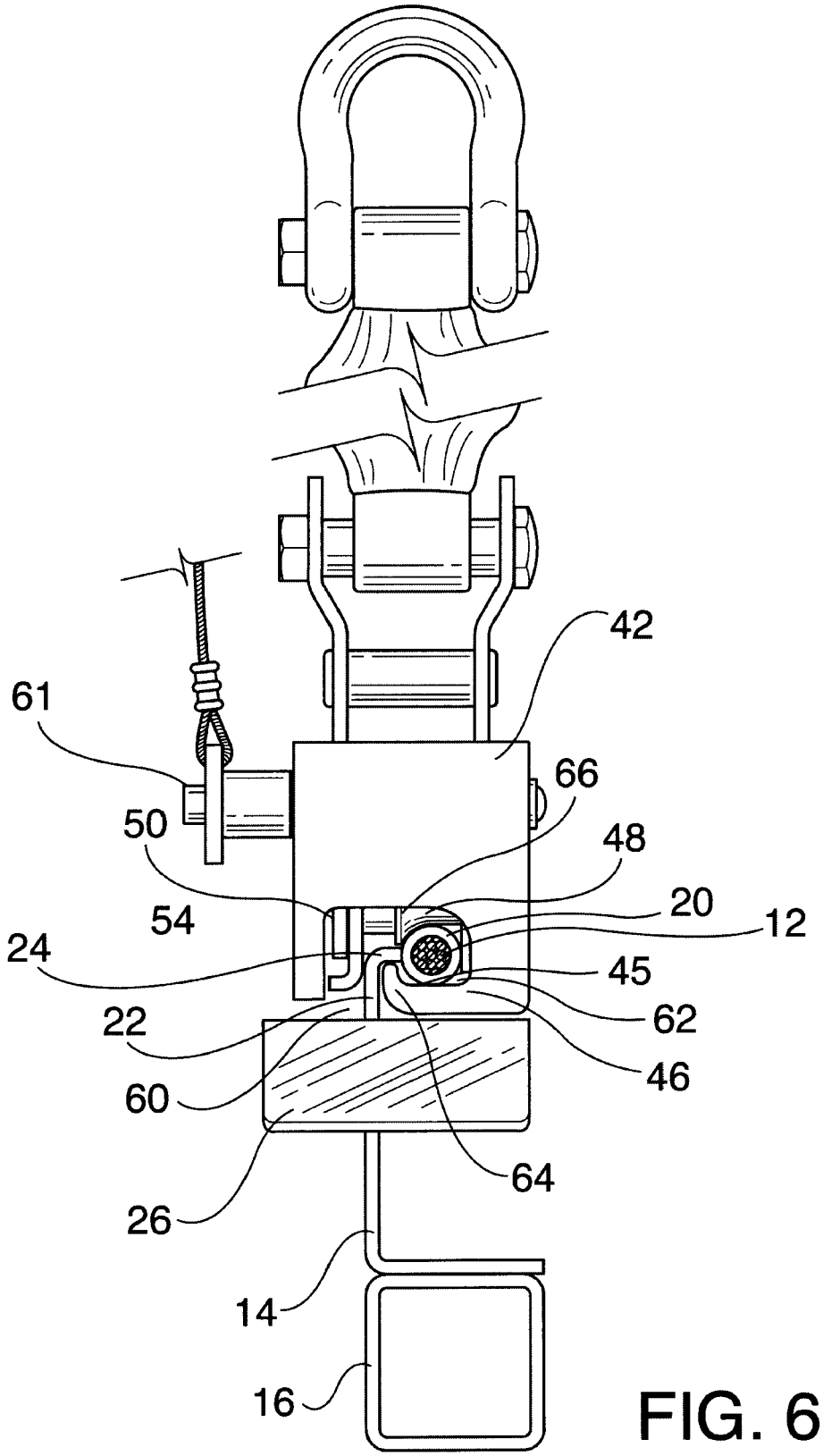
FIG. 6 is a top plan view of the pass-through cable grab attached to the cable.

The second function of the slot 60 is to allow the cable grab 10 to pass the standoff brackets 14 as the cable grab moves vertically up or down along the cable 12. As can be seen best from FIG. 6 the first portion 22 of the bracket 14 simply passes through the slot 60 while the cable 12 or sleeve 20 remain in their proper position in the opening 62. As pointed out above, the cable 12 is essentially locked in place and cannot be dislodged from its proper position between the wheel 48 and the surface 45 of the wall 46.

As a workman ascends or descends the tower, he may be off to one side of the cable 12. This could cause the cable grab 10 to rotate somewhat about the axis of the cable 12. A small amount of rotation would not cause a problem. However, too much rotation could cause the housing 42 to rotate to the point that one of the top or bottom corners thereof could engage top or bottom of the forward end of the standoff 14. The cam surfaces 26, 28 and 30 described above prevent this from happening. For example, when the cable grab 10 is moving downwardly and if the housing 42 is rotated to one side, the leading corner of the rear wall 46 will engage the surface 26 which will cause the housing to rotate back into its proper position. The essentially flat outer surface of the rear wall 46 will then engage the cam surface 28 which will keep the cable grab 10 properly aligned as it passes the standoff 14. Obviously, the same will be accomplished by the lower cam surface 30, if necessary, as the cable grab 10 is moving upwardly. As pointed out above and as can be seen from the drawings, the cam surfaces 26, 28 and 30 are mounted near the forward end of the bracket 14 but are spaced rearwardly of the sleeve 20 and the cable 12 thereby leaving a space between the cable 12 and the cam surfaces so that the rear wall 46 can pass therebetween.

The present invention may be embodied in other specific forms without departing from the spirit or essential attributes thereof and accordingly reference should be made to the appended claims rather than to the foregoing specification as indicating the scope of the invention.

I claim:

1. A pass-through cable grab system which allows a workman wearing a harness to move up and down a ladder on a tower or similar structure while being protected from falling by a vertically extending safety cable attached to said tower comprising:

a standoff bracket having a rear end adapted to be secured to said tower and a forward end secured to said cable;

a cable grab assembly including a housing adapted to move vertically up and down said cable, said housing including a rear wall adjacent said standoff bracket;

a brake mechanism located within said housing and adapted to prevent said housing from moving downwardly when said brake mechanism is activated;

said cable grab assembly further including a lever extending therefrom and adapted to be connected to said workman, whereby, in the event of a fall by said workman, said lever moves downwardly activating said brake mechanism;

said housing including a vertically extending slot in said rear wall which allows said cable grab assembly to pass over said forward end of said standoff bracket as said cable grab assembly moves up and down said cable, and wherein said standoff bracket includes a cam surface adjacent the top thereof, said cam surface being mounted on said bracket near said forward end thereof but spaced from said cable thereby leaving a space between said cable and said cam surface to allow said rear wall to pass therebetweeen, said cam surface being capable of engaging said rear wall of said housing as it moves downwardly to properly align said cable grab assembly so that it can pass over said forward end of said standoff bracket.

2. The pass-through cable grab system as claimed in claim 1 wherein said standoff bracket includes a first portion extending directly away from said tower and a second portion connected to said first portion that extends in an angular direction therefrom, the distal end of said second portion being attached to said cable.

3. A pass-through cable grab system which allows a workman wearing a harness to move up and down a ladder on a tower or similar structure while being protected from falling by a vertically extending safety cable attached to said tower comprising:

a standoff bracket having a rear end adapted to be secured to said tower and a forward end secured to said cable;

a cable grab assembly including a housing adapted to move vertically up and down said cable, said housing including a rear wall adjacent said standoff bracket;

a brake mechanism located within said housing and adapted to prevent said housing from moving downwardly when said brake mechanism is activated;

said cable grab assembly further including a lever extending therefrom and adapted to be connected to said workman, whereby, in the event of a fall by said workman, said lever moves downwardly activating said brake mechanism;

said housing including a vertically extending slot in said rear wall which allows said cable grab assembly to pass over said forward end of said standoff bracket as said cable grab assembly moves up and down said cable, and wherein said standoff bracket includes a cam surface adjacent the bottom thereof, said cam surface being mounted on said bracket near said forward end thereof but spaced from said cable thereby leaving a space between said cable and said cam surface to allow said rear wall to pass therebetweeen, said cam surface being capable of engaging said rear wall of said housing as it moves downwardly to properly align said cable grab assembly so that it can pass over said forward end of said standoff bracket.

4. The pass-through cable grab system as claimed in claim 3 wherein said standoff bracket includes a first portion extending directly away from said tower and a second portion connected to said first portion that extends in an angular direction therefrom, the distal end of said second portion being attached to said cable.

* * * * *